US009853396B1

(12) United States Patent
Musick

(10) Patent No.: US 9,853,396 B1
(45) Date of Patent: Dec. 26, 2017

(54) ELECTRICAL PLUG HAVING A FLEXIBLE TERMINAL RETENTION FEATURE

(71) Applicant: Delphi Technologies, Inc., Troy, MI (US)

(72) Inventor: Steven A. Musick, Burton, OH (US)

(73) Assignee: DELPHI TECHNOLOGIES, INC., Troy, MI (US)

( * ) Notice: Subject to any disclaimer, the term of this patent is extended or adjusted under 35 U.S.C. 154(b) by 0 days.

(21) Appl. No.: 15/369,006

(22) Filed: Dec. 5, 2016

(51) Int. Cl.

| | |
|---|---|
| ***H01R 13/40*** | (2006.01) |
| ***H01R 13/631*** | (2006.01) |
| ***H01R 13/04*** | (2006.01) |
| ***H01R 13/405*** | (2006.01) |

(52) U.S. Cl.
CPC ..... *H01R 13/6315* (2013.01); *H01R 13/04* (2013.01); *H01R 13/405* (2013.01)

(58) Field of Classification Search
CPC H01R 13/6315; H01R 13/6645; H01R 31/06; H01R 25/006; H01R 13/662; H01R 13/405; H01R 13/04
USPC ..... 439/595
See application file for complete search history.

(56) References Cited

U.S. PATENT DOCUMENTS

| | | | | |
|---|---|---|---|---|
| 6,644,986 | B1 * | 11/2003 | Wilker, Sr. | H01R 25/006 439/106 |
| 7,654,838 | B1 * | 2/2010 | Zhuge | H01R 13/652 439/173 |
| 2005/0153587 | A1 * | 7/2005 | Hsu | H01R 13/44 439/171 |
| 2005/0275981 | A1 * | 12/2005 | Power | H01H 83/04 361/42 |
| 2006/0038047 | A1 * | 2/2006 | Anderson | E03C 1/2665 241/46.013 |
| 2014/0084678 | A1 * | 3/2014 | Isaac | H01R 31/06 307/10.1 |
| 2014/0111000 | A1 * | 4/2014 | Cooney | H01R 13/645 307/9.1 |
| 2015/0066257 | A1 * | 3/2015 | Ochocinski | B60K 28/066 701/22 |

* cited by examiner

*Primary Examiner* — Jean F Duverne
(74) *Attorney, Agent, or Firm* — Robert J. Myers

(57) ABSTRACT

An electrical plug includes a first, second, and third plug terminal, and a terminal retainer configured to secure the first, second, and third plug terminals within the electrical plug. The first, second, and third plug terminal are attached to a first, second, and third electrical wire respectively. The terminal retainer defines a flexible structure in which the first plug terminal is secured, thereby allowing the first plug terminal to move independently of the second and third plug terminals. The flexible structure may be in the form of a cantilever beam, wherein the first plug terminal is secured in a location proximate a free end of the cantilever beam. The terminal retainer consists of a single piece of injection molded plastic. The electrical plug may be part of an electrical vehicle battery charger.

12 Claims, 9 Drawing Sheets

ELECTRICAL PLUG HAVING A FLEXIBLE TERMINAL RETENTION FEATURE

TECHNICAL FIELD OF THE INVENTION

The present invention relates generally to electrical plugs and, more particularly, to electrical plugs having flexible terminal retention features.

BACKGROUND OF THE INVENTION

Electrical plugs are used to connect electrical devices with electrical sockets. There are several issues that may arise in the use of these plug/socket combinations. As shown in FIG. 1, an operator 1 may attempt to remove the plug 3 from the socket by grasping the electrical cord 5 attached to the plug 3 and pulling on the cord 5 rather than properly grasping the plug 3. As shown in FIG. 2, this may cause the plug 3 to rotate in the socket and cause damage to the terminals 2 that result in increased electrical resistance and resulting in higher terminal temperatures in use or could cause a terminal to facture. This is particularly true of plugs conforming to the National Electrical Manufacturers Association (NEMA) 5-15P standard connected within sockets conforming to the NEMA 5-15S standard. These plugs have two blade style terminals (neutral and hot) that are aligned with the direction of rotation and one round pin terminal (ground). The blade terminals can easily rotate within their rectangular sockets, but the round terminal is constrained within its round socket and is more likely to bend or break.

Similar rotation of the plug 3 in the socket may also be caused by an electrical device 6, such as an electric vehicle battery charger, also known as electric vehicle service equipment (EVSE), hanging from an outlet 7 where the socket 8 is oriented such that the cord exits the top of the plug and then curves outwardly to extend to the EVSE as shown in FIG. 3.

Although this problem of plug rotation may more acutely affect angled plugs 3 having a 90 degree cord 5 to terminal 2 relationship as in the plugs shown in FIGS. 1-3, a straight plug 9 having a 180 degree relationship between the terminals 2 and the cord 5 as shown in FIG. 4 may also experience rotation in the socket that could damage the plug terminals if the cord or plug is pulled or yanked in an upward or downward direction.

Therefore, a needs exists for an electrical plug designed to inhibit damage to plug terminals caused by rotation of the plug terminals in the socket.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with an embodiment of the invention, an electrical plug, such as those used with an electrical vehicle battery charger, is provided. The electrical plug includes a first plug terminal, a second plug terminal, third plug terminal, and a terminal retainer configured to secure the first, second, and third plug terminals within the electrical plug. The terminal retainer defines a flexible structure in which the first plug terminal is secured, thereby allowing the first plug terminal to move independently of the second and third plug terminals.

The first plug terminal may have a round cross section and the second and third plug terminals may have a rectangular cross section. The second and third plug terminals may be aligned on a first lateral axis while the first plug terminal is aligned on a second lateral axis different than the first lateral axis such as those conforming to conform to NEMA 5-15P standards. The terminal retainer may consist of a single piece of injection molded plastic.

The flexible structure is in the form of a cantilever beam and wherein the first plug terminal is secured in a location proximate a free end of the cantilever beam. The first plug terminal may define a circumferential flange.

The electrical plug may further include a housing in which the terminal retainer is disposed. The housing may be formed of a polymeric material and may be over-molded on the terminal retainer. The electrical plug may further include a first, second, and third electrical wire interconnected with the first, second, and third plug terminals respectively. The electrical plug is interconnected by the first, second, and third electrical wires to an electric vehicle battery charger. A portal may be defined in the housing that is configured to allow the first, second, and third electrical wires to exit the housing. This portal is located closer to the first plug terminal than the second and third plug terminals. The first, second, and third electrical wires may exit the housing along an axis that is substantially perpendicular to a longitudinal axis of the first plug terminal.

The foregoing and other objects, features, and advantages of the invention will be apparent from the following detailed descriptions of embodiments of the invention the accompanying drawings of these embodiments.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Presented herein is a description an electrical plug that includes a flexible structure in which one of plug terminals is secured, thereby allowing the first plug terminal to move independently of the other plug terminals and reducing the occurrence of damage to the terminals caused by improper removal of the electrical plug from an electrical socket.

Figure 5:
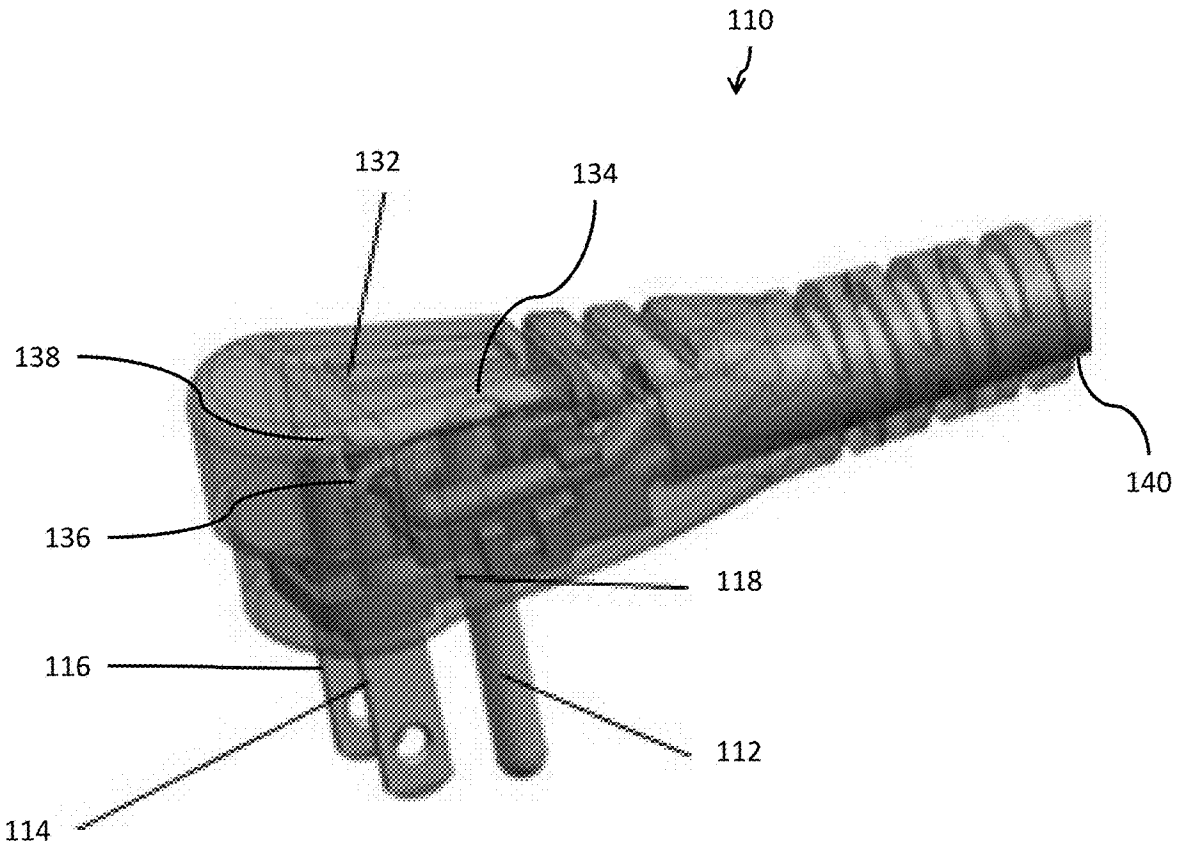
FIG. 5 is a perspective cut away view of an electrical plug having a flexible structure in which a plug terminal is secured according to an embodiment of the invention.

FIGS. 5-9 illustrate a non-limiting example of an electrical plug 110 conforming to the National Electrical Manufacturers Association (NEMA) 5-15P standard, hereinafter referred to as a plug 110. As shown in FIG. 5, the plug 110 includes a first plug terminal 112 in the form of a pin having a generally rounded cross section, hereinafter referred to as a ground terminal 112, a second plug terminal 114 in the form of a blade having a generally rectangular cross section, hereinafter referred to as a neutral terminal 114, and a third plug terminal 116 in the form of a blade having a slightly smaller rectangular cross section than the neutral terminal 114, hereinafter referred to as a hot terminal 116. The plug 110 further includes a terminal retainer 118 that secures the ground, neutral, and hot terminals 112, 114, 116 within the plug 110. The terminal retainer 118 rigidly retains the hot and neutral terminals 114, 116 while having a flexible structure 120 in which the ground terminal 112 is retained.

Figure 6:
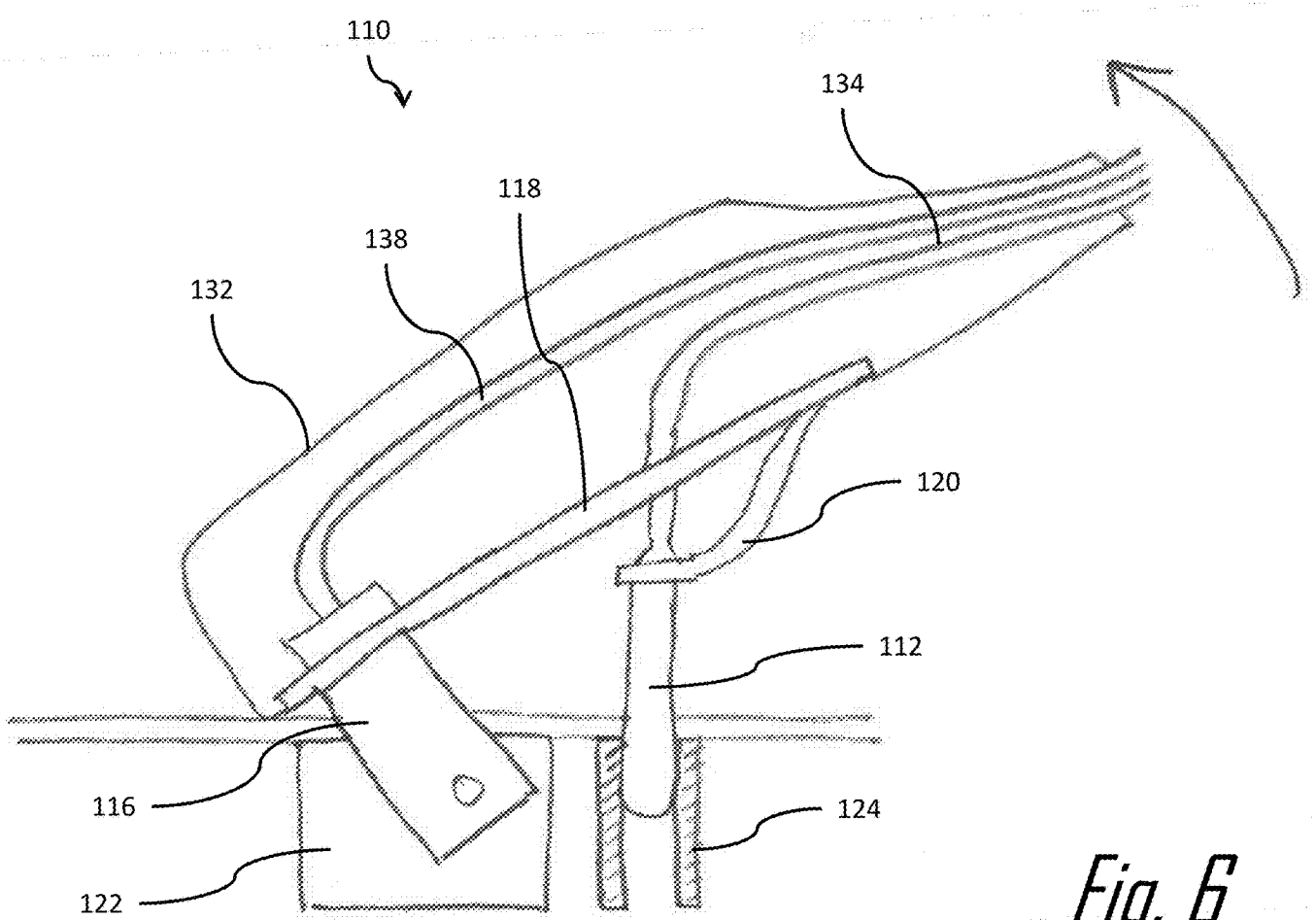
FIG. 6 is a side cut away view of an electrical plug having a flexible structure in which a plug terminal is secured according to an embodiment of the invention.

As illustrated in FIG. 6, the neutral and hot terminals 114, 116 are free to rotate since the blades of these terminals 114, 116 are generally parallel to the corresponding sockets 122 while the round ground terminal 112 is substantially surrounded by the round ground socket 124. This inhibits the ground terminal 112 from rotating in the ground socket. The flexible structure 120 allows the ground terminal 112 to move independently of the neutral and hot terminals 114, 116 so that the neutral and hot terminals 114, 116 can rotate in the neutral and hot sockets 122 of the outlet while the ground terminal 112 does not rotate in the ground socket 124.

Figure 7:
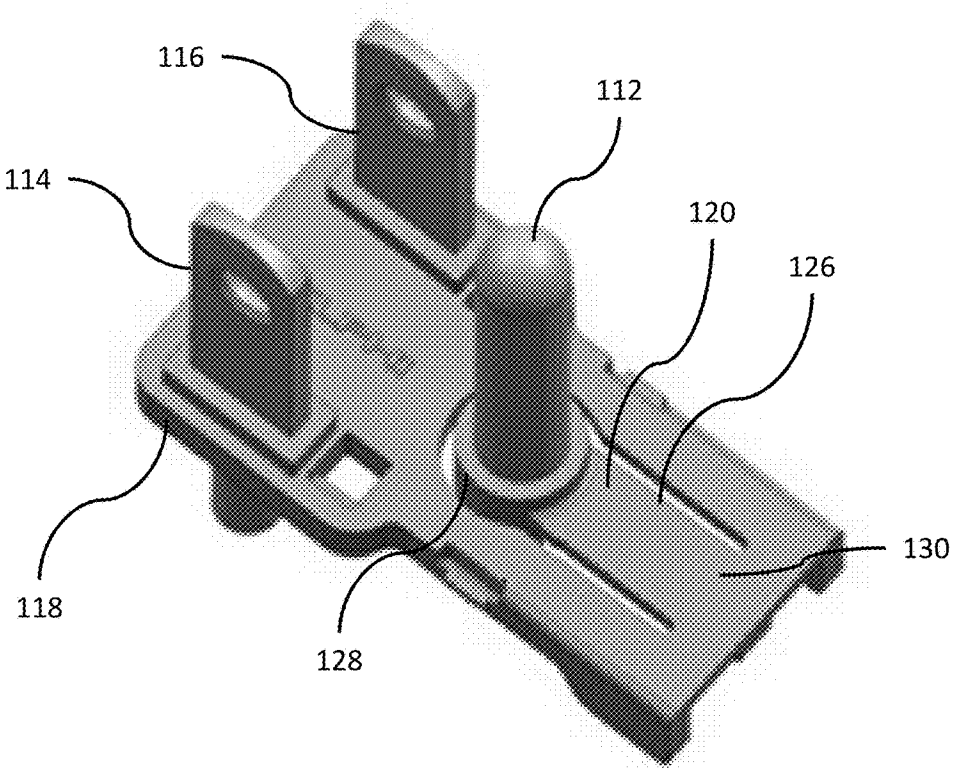
FIG. 7 is a bottom perspective view of a plug terminal retainer configured to secure the first, second, and third plug terminals within the electrical plug of FIG. 5 having a flexible structure in which the first plug terminal is secured according to an embodiment of the invention.

As best illustrated in FIG. 7, the flexible structure 120 is in the form of a cantilever beam 126 having a free end 128 and a fixed end 130. The ground terminal 112 is secured to the terminal retainer 118 at the free end 128 of the cantilever beam 126. The terminal retainer 118 and the flexible structure 120 are integrally formed of a single piece of injection molded plastic.

As shown in FIG. 5, the plug 110 further includes a housing 132 in which the terminal retainer 118 is disposed. The housing is formed of a polymeric material and is over-molded the terminal retainer 118. A first, second, and third electrical wire 134, 136, 138, hereinafter referred to as the ground wire, neutral wire, and hot wire 134, 136, 138 respectively, are interconnected to the interconnected with the ground, neutral, and hot terminals 112, 114, 116 respectively. A wire exit portal 140 is defined in the housing configured to allow the ground, neutral, and hot wires 134, 136, 138 to exit the housing. The portal is located closer to the ground terminal 112 than the neutral and hot terminals 114, 116. The plug 110 illustrated here has a right angle or ninety degree configuration so that the ground, neutral, and hot wires 134, 136, 138 exit the housing along an axis (Y) that is substantially perpendicular to a longitudinal axis (X) of the ground terminal 112. As used herein, substantial perpendicular means±10° of absolutely perpendicular. Other embodiments of the plug may be a straight configuration in which the ground, neutral, and hot wires exit the housing along an axis that is substantially parallel to a longitudinal axis of the ground terminal. As used herein, substantial parallel means±10° of absolutely parallel.

Figure 8:
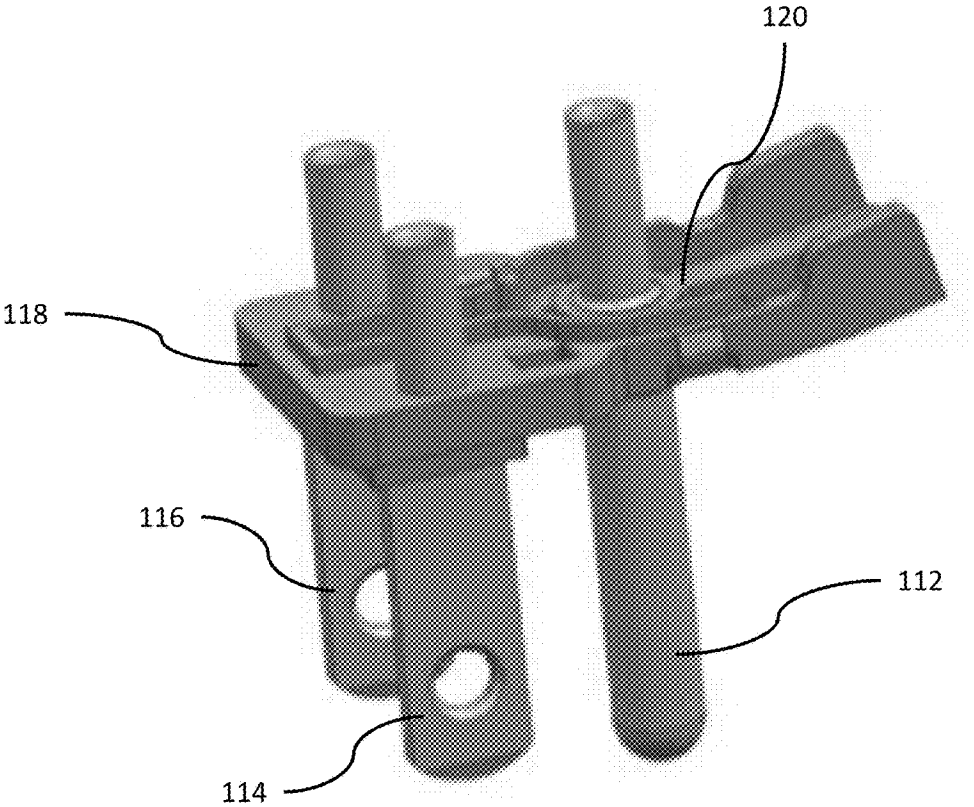
FIG. 8 is a top perspective view of the plug terminal retainer of FIG. 6 according to an embodiment of the invention.
Figure 9:
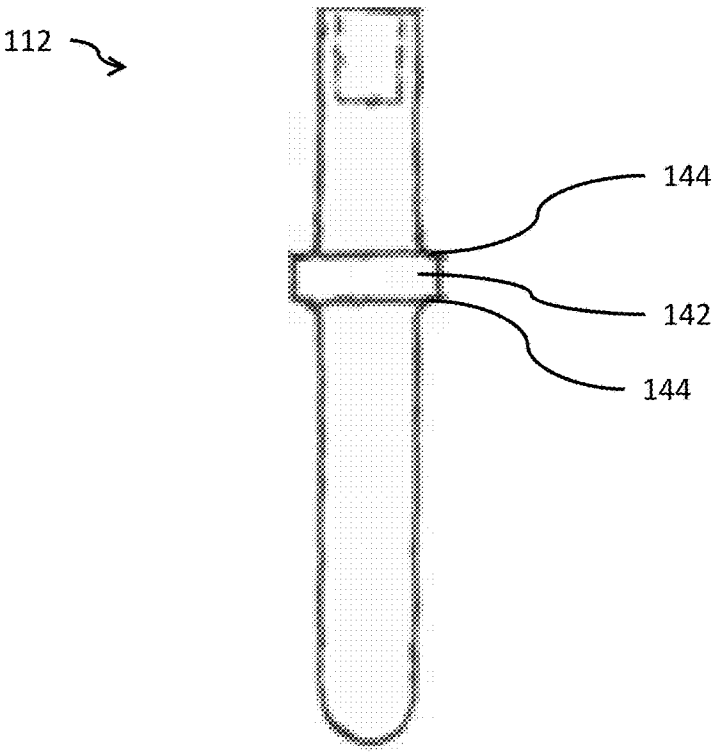
FIG. 9 is a side view of the first plug terminal of the electrical plug according to an embodiment of the invention.

As best shown in FIG. 9, the ground terminal 112 includes a circumferential flange 142. This flange 142 is captured within the flexible structure 120 by molding the terminal retainer 118 over the flange 142 as shown in FIGS. 7 and 8. Prior art embodiments of the ground pin originally had an undercut with serrations in the metal of the ground pin to facilitate grip between the ground terminal and the material forming the terminal retainer. This undercut design also had sharp corners that rendered the ground terminal more susceptible to fracture from bending forces. The ground terminal 112 and flange 142 do not include any metal serrations to facilitate grip. Rather, the flange 142 has a fillet 144 to facilitate grip of the material forming the terminal retainer 118 to the ground terminal 112 and provide increased resistance to bending forces in this region of the ground terminal 112.

Figure 1:
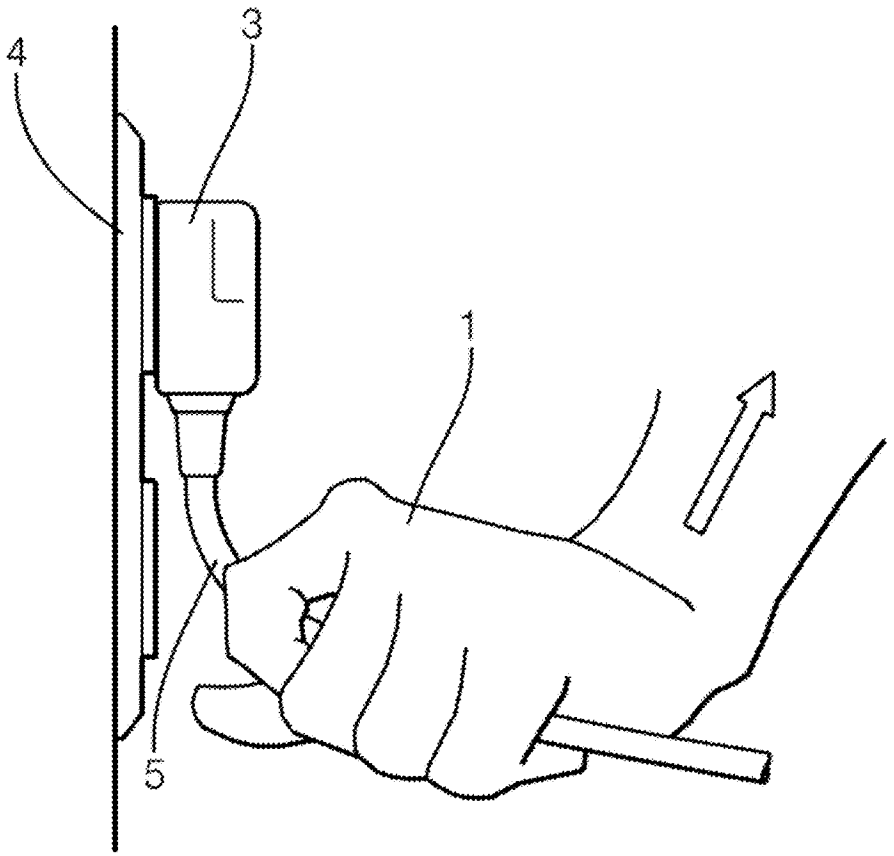
Fig. 1 PRIOR ART
FIG. 1 is a side view of an operator improperly removing an electrical plug from an electrical socket according to the prior art.
Figure 2:
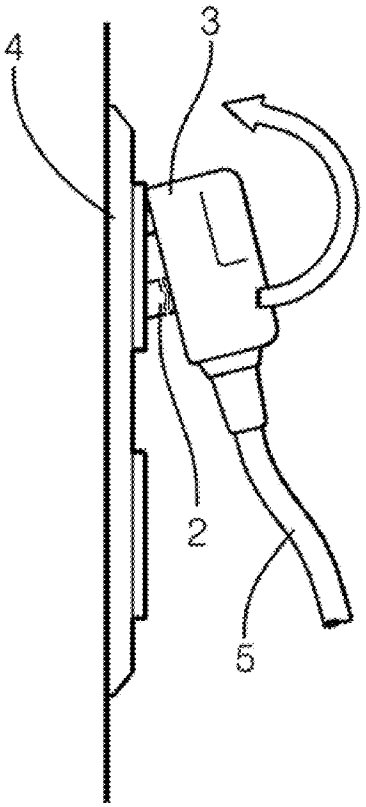
PRIOR ART Fig. 2
FIG. 2 is a side view of rotation of a ninety degree electrical plug in the electrical socket according to the prior art.
Figure 3:
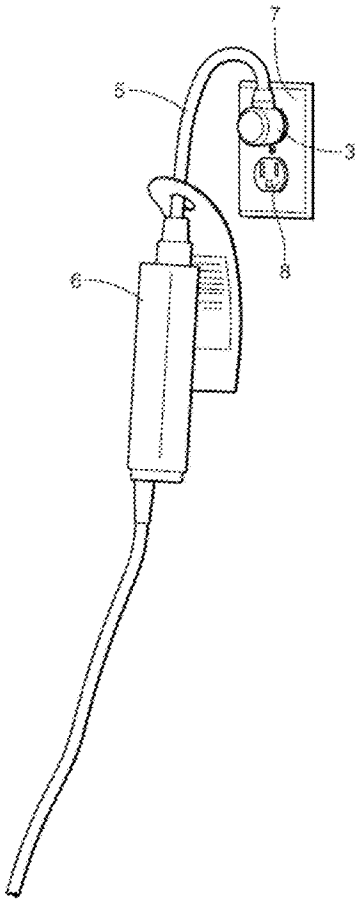
FIG. 3 is a perspective view of an electrical device hanging from an electrical plug in an electrical socket according to the prior art.
Figure 4:
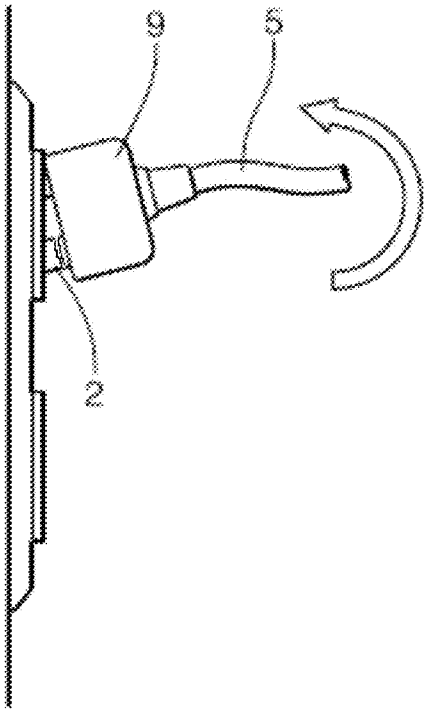
PRIOR ART Fig. 4
FIG. 4 is a side view of rotation of a straight electrical plug in an electrical socket according to the prior art.

Accordingly, an electrical plug 110 having terminal retainer 118 with a flexible feature that allows at least one of the plug terminals 112 to move independently of the other plug terminals 114, 116 is presented. The flexible structure 120 allows one of the plug terminals 112 to be held in a fixed orientation in a socket 124 while the other plug terminals 114, 116 are rotated within their respective sockets 122, for example by improper plug removal technique by an operator as shown in FIG. 1 or equipment hanging from the plug as shown in FIG. 3. Allowing one or more fixed terminals 112 to move independently of other terminals 114, 116 reduces the likelihood of damage or breakage of that terminal 112 of the plug is improperly rotated during removal from or insertion into a corresponding electrical socket.

The illustrated embodiments conform to the NEMA 5-15P standard. However, other embodiments of the invention that conform to different technical standards, such as Europlug CCE 7/16, British Standard (BS) 1363, Australian/New Zealand Standard AS/NZS 3112, or Chinese PPCS-CCC technical standards, but especially to plugs having a mix of parallel blade terminals and round terminals, e.g. NEMA 5-15P, 6-15P, 6-30P, 6-50P, and 14-50P, may be envisioned that provide similar benefits.

While this invention has been described in terms of the preferred embodiments thereof, it is not intended to be so limited, but rather only to the extent set forth in the claims that follow. Moreover, the use of the terms first, second, upper, lower, etc. does not denote any order of importance, location, or orientation, but rather the terms first, second, etc. are used to distinguish one element from another. Furthermore, the use of the terms a, an, etc. do not denote a limitation of quantity, but rather denote the presence of at least one of the referenced items.

I claim:

1. An electrical plug, comprising:

a first plug terminal, a second plug terminal, and third plug terminal; and a terminal retainer configured to secure the first, second, and third plug terminals within the electrical plug, said terminal retainer defining a flexible structure in which the first plug terminal is secured, thereby allowing the first plug terminal to move independently of the second and third plug terminals.

2. The electrical plug according to claim 1, wherein the first plug terminal has a round cross section and the second and third plug terminals have a rectangular cross section and wherein the second and third plug terminals are aligned on a first lateral axis and the first plug terminal is aligned on a second lateral axis.

3. The electrical plug according to claim 2, wherein the flexible structure is in the form of a cantilever beam and wherein the first plug terminal is secured in a location proximate a free end of the cantilever beam.

4. The electrical plug according to claim 2, wherein the first plug terminal defines a circumferential flange.

5. The electrical plug according to claim 2, wherein the electrical plug is configured to conform to NEMA 5-15P standards.

6. The electrical plug according to claim 1, wherein the terminal retainer consists of a single piece of injection molded plastic.

7. The electrical plug according to claim 1, further comprising a housing in which the terminal retainer is disposed.

8. The electrical plug according to claim 7, wherein the housing is formed of a polymeric material and is overmolded the terminal retainer.

9. The electrical plug according to claim 7, further comprising a first, second, and third electrical wire interconnected with the first, second, and third plug terminals respectively.

10. The electrical plug according to claim 9, wherein the electrical plug is interconnected with an electric vehicle battery charger.

11. The electrical plug according to claim 9, wherein a portal is defined in the housing configured to allow the first, second, and third electrical wires to exit the housing and wherein said portal is located closer to the first plug terminal than the second and third plug terminals.

12. The electrical plug according to claim 11, wherein the first, second, and third electrical wires to exit the housing along an axis that is substantially perpendicular to a longitudinal axis of the first plug terminal.

* * * * *